US012560401B2

(12) United States Patent
Alqasimi

(10) Patent No.: US 12,560,401 B2
(45) Date of Patent: Feb. 24, 2026

(54) FIREARM MAGAZINE WITH DEPLOYABLE STAND

(71) Applicant: CONSONANCE ENGINEERING SOLUTIONS LLC, Wesley Chapel, FL (US)

(72) Inventor: Ahmad Alqasimi, Wesley Chapel, FL (US)

(73) Assignee: CONSONANCE ENGINEERING SOLUTIONS, LLC, Wesley Chapel, FL (US)

( * ) Notice: Subject to any disclaimer, the term of this patent is extended or adjusted under 35 U.S.C. 154(b) by 0 days.

(21) Appl. No.: 18/603,963

(22) Filed: Mar. 13, 2024

(65) Prior Publication Data

US 2024/0310138 A1 Sep. 19, 2024

Related U.S. Application Data

(60) Provisional application No. 63/490,001, filed on Mar. 14, 2023.

(51) Int. Cl.
*F41A 23/18* (2006.01)
*F41A 23/00* (2006.01)

(52) U.S. Cl.
CPC ..... *F41A 23/18* (2013.01); *F41A 23/00* (2013.01)

(58) Field of Classification Search
CPC ..... F41A 23/18; F41A 23/00; F41A 23/52; F41A 17/10; F41A 17/12; A47B 81/005; A47B 81/00; A47G 25/0261; Y10T 16/522
See application file for complete search history.

(56) References Cited

U.S. PATENT DOCUMENTS 2,763,456 A * 9/1956 Breer ..... F16M 11/08 248/188.4
3,235,997 A * 2/1966 Stoner ..... F41A 23/08 89/37.03
3,632,073 A * 1/1972 Nakatani ..... F16M 11/242 248/169
4,017,997 A * 4/1977 Peterson ..... F41A 23/08 42/94
4,121,799 A * 10/1978 Michio ..... F16M 11/38 248/188.7
4,776,124 A * 10/1988 Clifton ..... F41A 23/08 42/94
4,807,837 A * 2/1989 Gawlik ..... A61M 5/1415 211/196

(Continued)

*Primary Examiner* — Nkeisha Smith

(57) ABSTRACT

A stand assembly for providing support to a firearm comprises a housing and a base. The housing includes a track body. The track body defines a plurality grooves. A tracking mechanism is configured to slidably engage the track body and navigate along the plurality of grooves. A joint mechanism is coupled to the tracking mechanism. A plurality of support members and a pull rod are coupled to the joint mechanism. The base is secured to the pull rod and is configured to releasably circumscribe an outer surface of the housing. The plurality of support members are configured to transition from a retracted position within the housing to a deployed position outside of the housing when the base is released from the outer surface of the housing and moved distally away from the housing.

19 Claims, 9 Drawing Sheets

(56) References Cited

U.S. PATENT DOCUMENTS 5,384,609 A * 1/1995 Ogawa ..... F16M 11/10 396/419
5,438,786 A * 8/1995 Hilderbrand ..... F41A 23/14 248/171
6,487,807 B1 * 12/2002 Kopman ..... F41A 23/12 42/72
7,111,424 B1 * 9/2006 Moody ..... G03B 17/561 42/72
7,124,528 B2 10/2006 Long
7,409,791 B2 * 8/2008 Moody ..... F41A 23/08 42/72
7,421,815 B1 * 9/2008 Moody ..... F41A 23/08 42/72
7,559,167 B1 * 7/2009 Moody ..... F41C 23/16 42/71.01
7,568,304 B1 * 8/2009 Moody ..... F41C 23/16 42/71.01
7,584,568 B1 * 9/2009 Brownlee ..... F41C 23/16 89/37.01
7,665,239 B1 * 2/2010 Moody ..... F41A 23/08 42/72
7,665,241 B2 * 2/2010 Oz ..... F41A 23/08 89/37.04
7,669,357 B2 * 3/2010 Moody ..... F41A 23/08 42/72
7,743,545 B1 * 6/2010 Moody ..... F41A 23/10 248/161
7,823,855 B2 * 11/2010 Faifer ..... F16M 11/26 248/188.5
7,909,301 B2 * 3/2011 Faifer ..... F41C 23/16 248/188.5
7,987,625 B1 * 8/2011 Moody ..... F41C 23/16 248/161
8,225,543 B2 * 7/2012 Moody ..... F41G 1/44 42/72
8,356,440 B2 1/2013 Troy
8,443,538 B1 5/2013 Moody
8,590,202 B2 11/2013 Keng
9,097,480 B2 8/2015 Keng
9,380,904 B2 * 7/2016 Peek ..... F16M 11/28
9,803,950 B1 * 10/2017 Khoshnood ..... F41A 23/08
10,041,761 B2 8/2018 Sitzman et al.
10,101,110 B2 10/2018 Faifer et al.
10,161,705 B2 12/2018 Keng et al.
10,480,891 B2 11/2019 Eccleshall
10,948,255 B2 3/2021 Keng
2005/0241206 A1 * 11/2005 Teetzel ..... F41A 23/08 42/72
2006/0277809 A1 * 12/2006 Moody ..... F41A 23/08 42/72
2008/0276518 A1 * 11/2008 Moody ..... F41A 23/08 42/72
2009/0038199 A1 * 2/2009 Oz ..... F41A 23/10 42/94
2010/0242332 A1 * 9/2010 Teetzel ..... F41A 23/22 42/72
2016/0363407 A1 12/2016 Hanington

* cited by examiner

FIREARM MAGAZINE WITH DEPLOYABLE STAND

CROSS-REFERENCE TO RELATED APPLICATION(S)

This application claims priority to U.S. Provisional Patent Application No. 63/490,001, entitled FIREARM STAND DEPLOYED FROM ITS MAGAZINE OR CASE LIKE MAGAZINE, filed on Mar. 14, 2023, the entirety of which is incorporated herein by reference.

FIELD OF THE INVENTION

The present invention relates to the field of firearms and firearm stands, and more specifically, to deployable and storable stands for use in supporting the weight of a firearm.

BACKGROUND OF THE INVENTION

In the field of firearms, existing stands that are used to display a firearm are often bulky, flat, and rigid. For example, such stands generally consist of a flat or planar base with an integrated post or aperture that may be engaged by the grip or barrel of a firearm to support the firearm's weight. Further, existing stands also often require the use of additional attachments or tools that must be coupled to a firearm, thereby increasing the firearm's overall footprint. As such, there is a need to improve the user experience when it comes to displaying a firearm. In particular, there is a need for an elegant manner of incorporating a stand into the existing general attachments and components of a firearm such that the overall footprint of the firearm does not greatly increase from the use of a stand.

SUMMARY OF THE INVENTION

Embodiments of the present invention address deficiencies of the art in respect to firearm stands.

According to one or more embodiments of the invention, a stand assembly for providing support to a firearm comprises a housing and a base. The housing includes a track body. The track body defines a plurality grooves. A tracking mechanism is configured to slidably engage the track body and navigate along the plurality of grooves. A joint mechanism is coupled to the tracking mechanism. A plurality of support members and a pull rod are coupled to the joint mechanism. The base is secured to the pull rod and is configured to releasably circumscribe an outer surface of the housing. The plurality of support members are configured to transition from a retracted position within the housing to a deployed position outside of the housing when the base is released from the outer surface of the housing and moved distally away from the housing.

In one aspect, the pull rod comprises an elongate body defining a channel therein.

In another aspect, a tensioning element is disposed within the channel.

In another aspect, the housing has a first end and an opposite second end. The second end defines an opening providing access to an interior of the housing.

In another aspect, moving the base distally away from the housing causes the pull rod to partially exit the housing through the opening.

In another aspect, the tensioning element becomes increasingly tensioned as the pull rod exits the housing through the opening.

In another aspect, the tensioning element is a spring.

In another aspect, the base defines a plurality of openings sized and configured to allow for passage of a support member when the plurality of support members are deployed from the housing.

In another aspect, upon full deployment of the plurality of support members, each support member may be locked in place to maintain their deployed position.

In another aspect, the base is configured to engage the housing and provide at least a partial seal over the opening when the plurality of support members are fully deployed from the housing.

According to one or more further embodiments of the present invention, a stand assembly for use with a projectile launcher comprises a housing. The housing includes a first end and a second end opposite the first end. The second end defines an opening that provides access to an interior of the housing. A tracking mechanism is disposed within the interior of the housing. A joint mechanism is coupled to the tracking mechanism. A plurality of support members are coupled to joint mechanism. The plurality of support members are configured to be readily deployed from and retracted within the interior of the housing through the opening.

In one aspect, deployment of the plurality of support members causes each support member to rotate about an axis when exiting the housing through the opening.

In another aspect, a pull rod is coupled to the joint mechanism.

In another aspect, a base is coupled to the pull rod and configured to releasably circumscribe a portion of the housing.

In another aspect, the base defines a plurality of openings sized and configured to allow for passage of a support member when the plurality of support members are deployed from the housing.

In another aspect, upon full deployment of the plurality of support members, each support member may be locked in place to maintain their deployed position.

In another aspect, the base is configured to engage the housing and provide at least a partial seal over the opening when the plurality of support members are fully deployed from the housing.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

As used herein, relational terms, such as "first" and "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Figure 1:
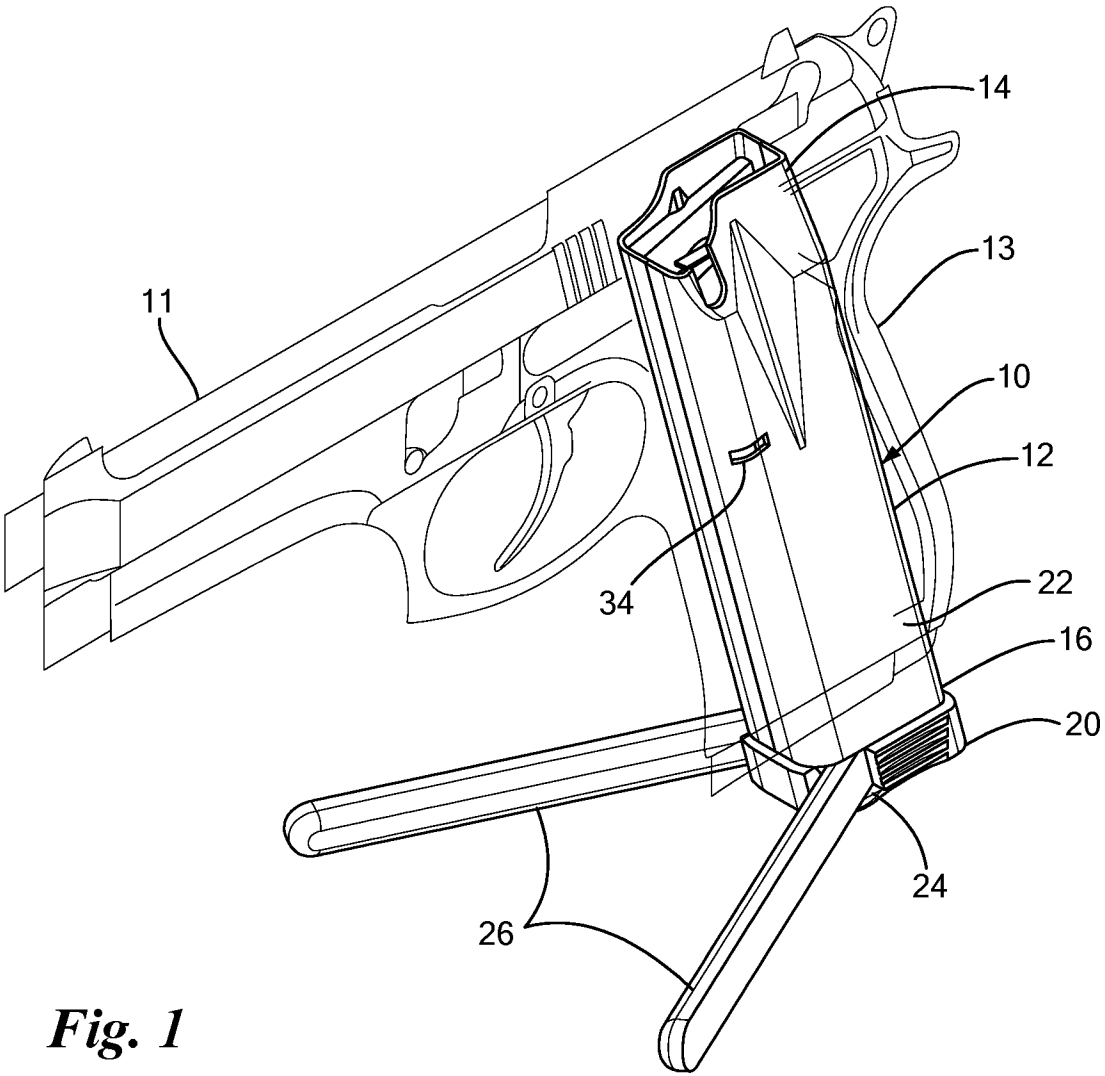
FIG. 1 is an isometric view of an exemplary stand assembly for use with a firearm, constructed in accordance with the principles of the present invention.

Now referring to the drawings in which like reference designators refer to like elements, there is shown in FIG. 1 a stand assembly constructed in accordance with the principles of the present invention and designated generally as "10." In one configuration, the stand assembly 10 is sized and configured to engage a firearm, such as a handgun, or other hand-held projectile launcher in place of a magazine, grip, or another similar firearm attachment. According to one or more embodiments, the stand assembly 10 includes a housing 12 that may be releasably attached to a firearm 11. In some embodiments, the housing 12 may be a housing of a firearm magazine that may be sized and configured to also retain, or not retain, live ammunition. As shown in FIG. 1, the housing 12 may be sized and configured to be received within the handle or grip 13 of the firearm 11. However, in other embodiments, the housing 12 itself may also function as a grip for the user or operator of the firearm 11.

Continuing to refer to FIG. 1, the housing 12 includes a first end 14 and a second end 16 opposite the first end 14. The second end 16 defines an opening 18 (as shown in FIG. 1) that provides access to an interior (or interior compartment) of the housing 12. The stand assembly 10 further includes a base 20 that may be releasably coupled to the housing 12 via a lip or rim 21 of the base 20 that is configured to circumscribe an outer surface 22 of the housing 12 near the second end 16, such that the base 20 provides at least a partial seal against the opening 18 of the second end 16 when coupled to the housing 12. As discussed in more detail below, the base 20 defines at least one opening 24 sized to allow for the passage of a supporting member that may be deployed from the interior of the housing 12.

Continuing to refer to FIG. 1, the stand assembly 10 is shown in a fully deployed state or position. When in the deployed state a plurality of support members 26 protrude out from the interior of the housing 12 such that each support member 26 may be extended through one of openings 24 of the base 20. The plurality of support members 26 may be configured to support the weight of the firearm 11 when rested on a surface (e.g., ground, table top, counter top, display shelf, etc.) so that the firearm may be readily displayed in an upright position for decorative purposes. It is to be understood that in some embodiments the plurality of support members 26 may be a plurality of support arms or legs each have an elongate body with a rounded, curved, and/or planar configuration. In some exemplary embodiments, a first portion of each support member 26 may be rounded or curved, and a second portion of each support member 26 may be flat or planar such that the support member 26 can be more well-balanced when resting on a surface to support the weight of the firearm 11.

Figure 2:
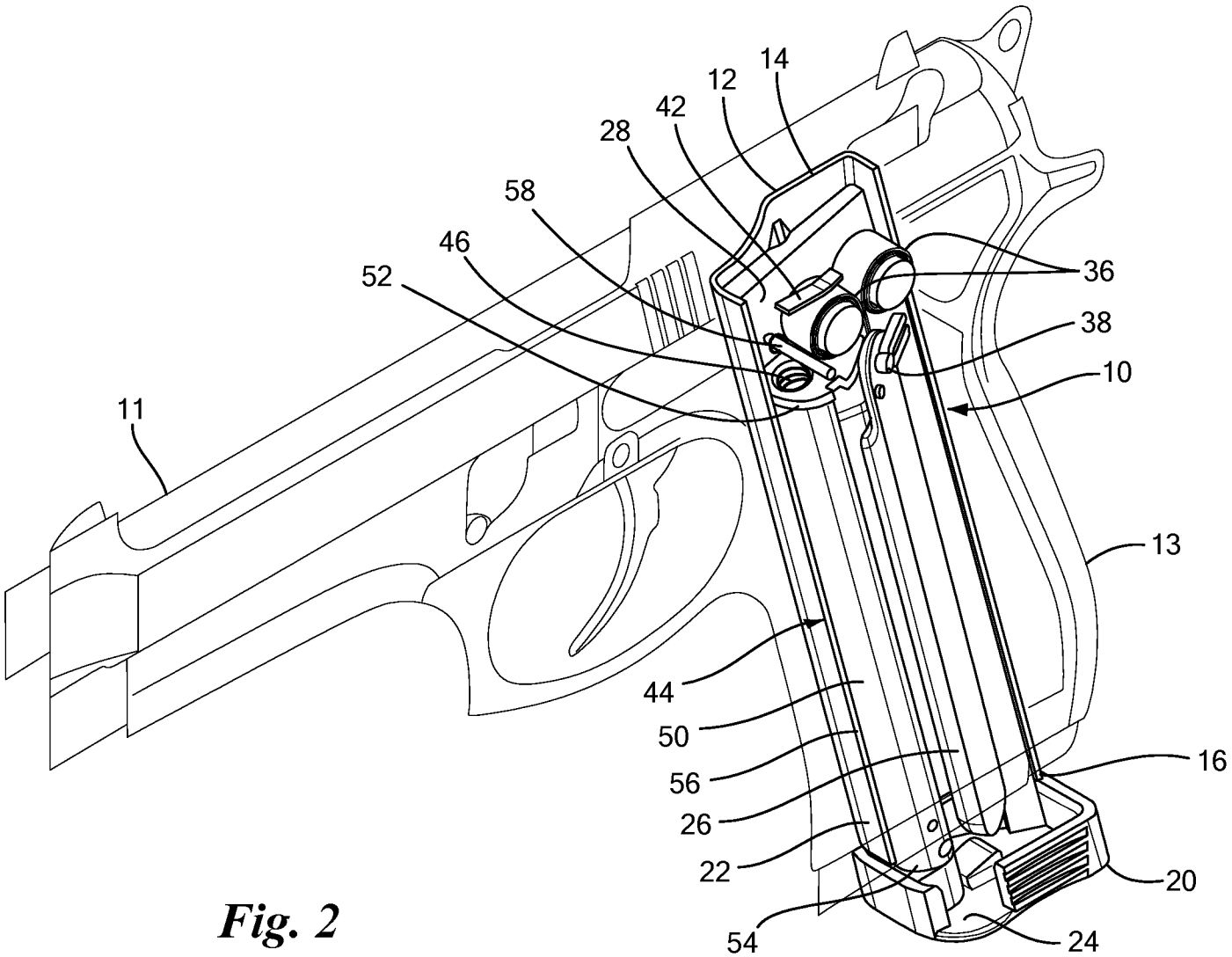
FIGS. 2 and 3 are isometric view illustrating an interior of a housing of the stand assembly of FIG. 1 when the stand assembly is in a stowed state in accordance with the principles of the present invention.

Now referring to FIG. 2, the stand assembly 10 is shown in a retracted or stowed state. When in the stowed state, the plurality of support members 26 are fully concealed and stored within the interior of the housing 12 such that they do not extend through the openings 24 of the base 20. In some exemplary embodiments, the plurality of support members 26 include two support members. However, it is to be understood that in some configurations the stand assembly 10 may include more than two support members 26 or one support member 26. It is also be to be understood that all of the support members 26 may have the same length size and/or length, or at least one support member 26 may differ in size and/or length from the others. However, all support members 26 shall be sized and configured to be fully storable within the housing 12 when the stand assembly 10 is in the stowed state.

Figure 3:
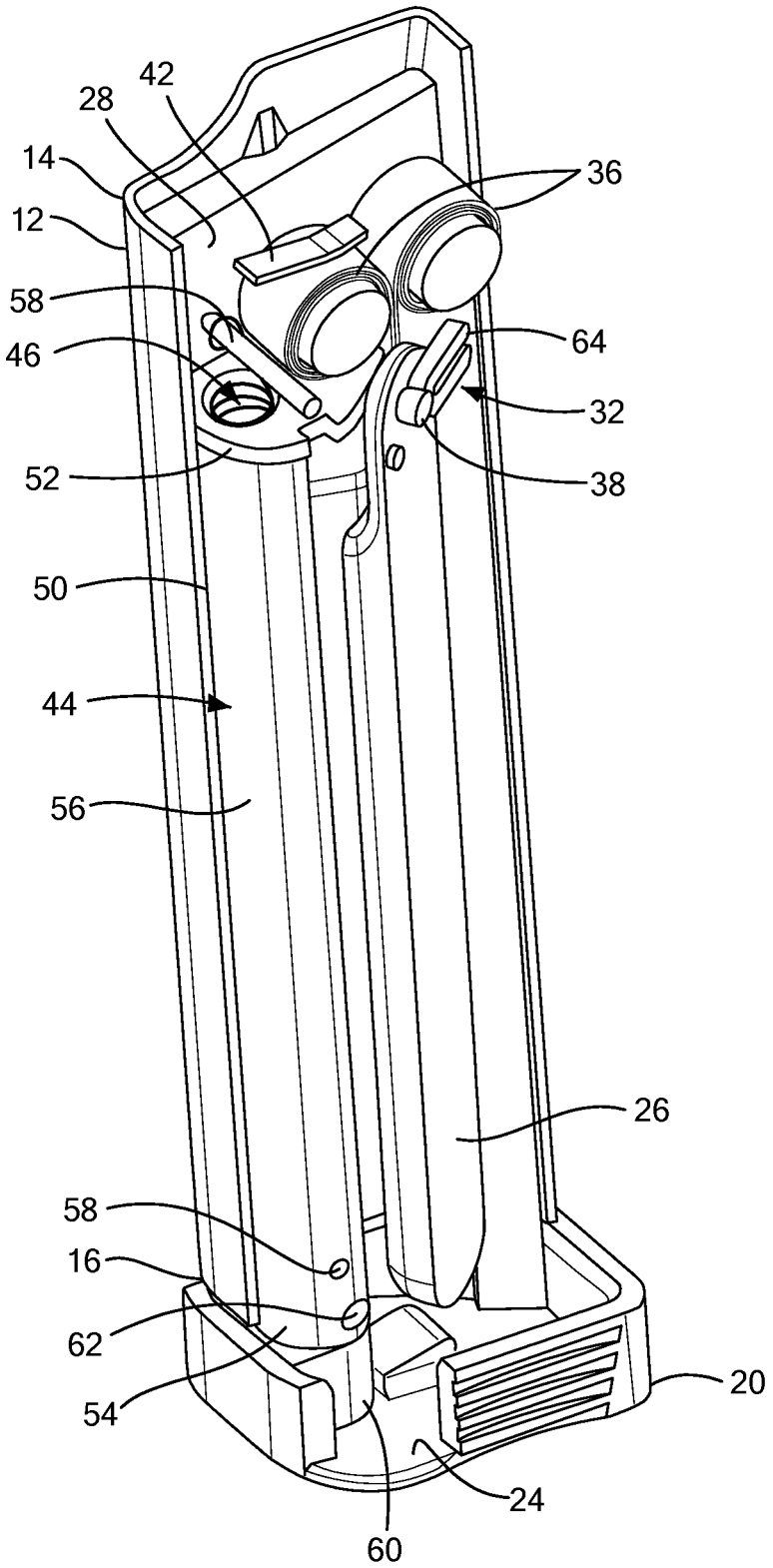
Figure 4:
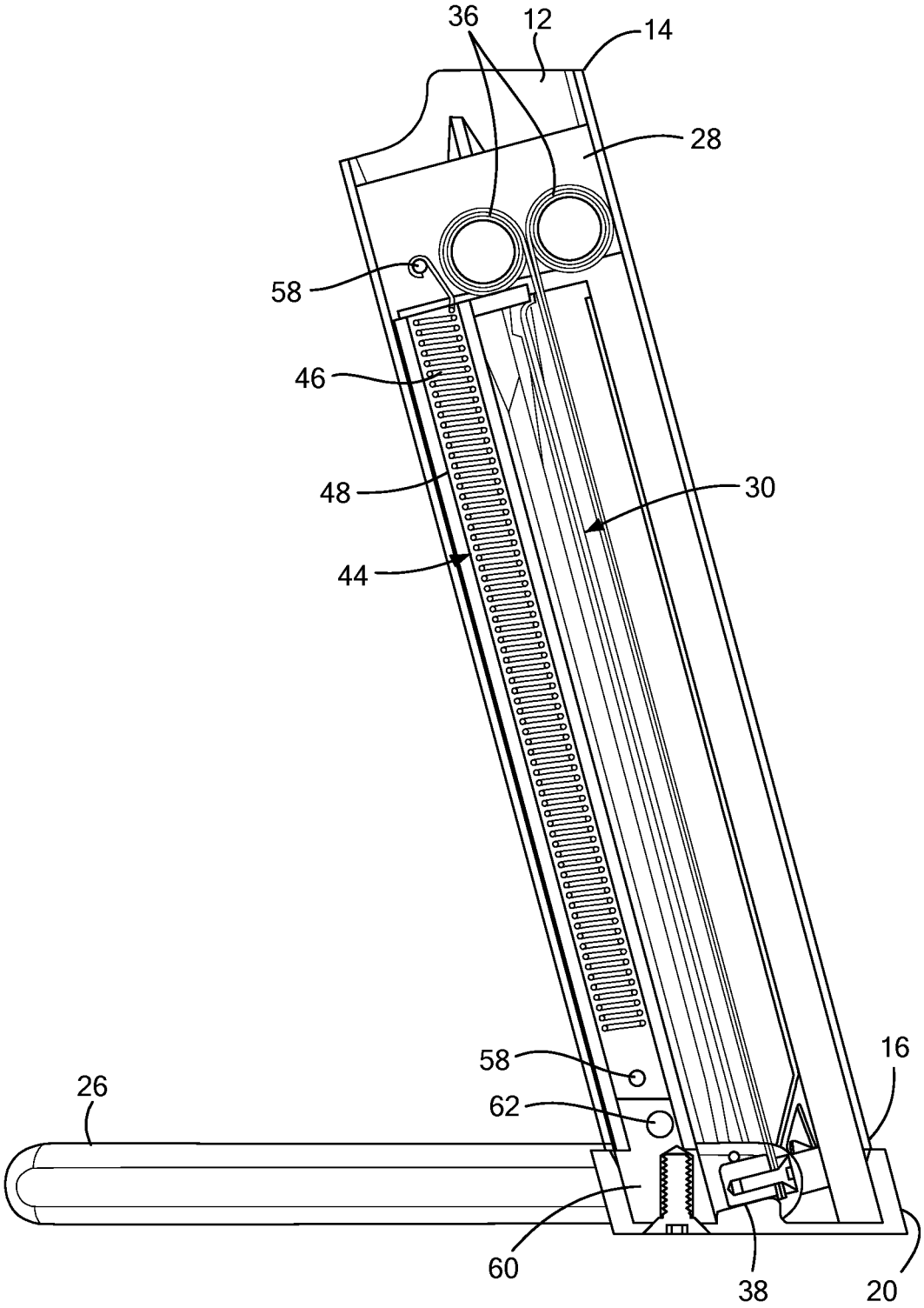
FIG. 4 is a side section view of the housing of FIGS. 2-3 when the stand assembly is in a deployed state, in accordance with the principles of the present invention.
Figure 7:
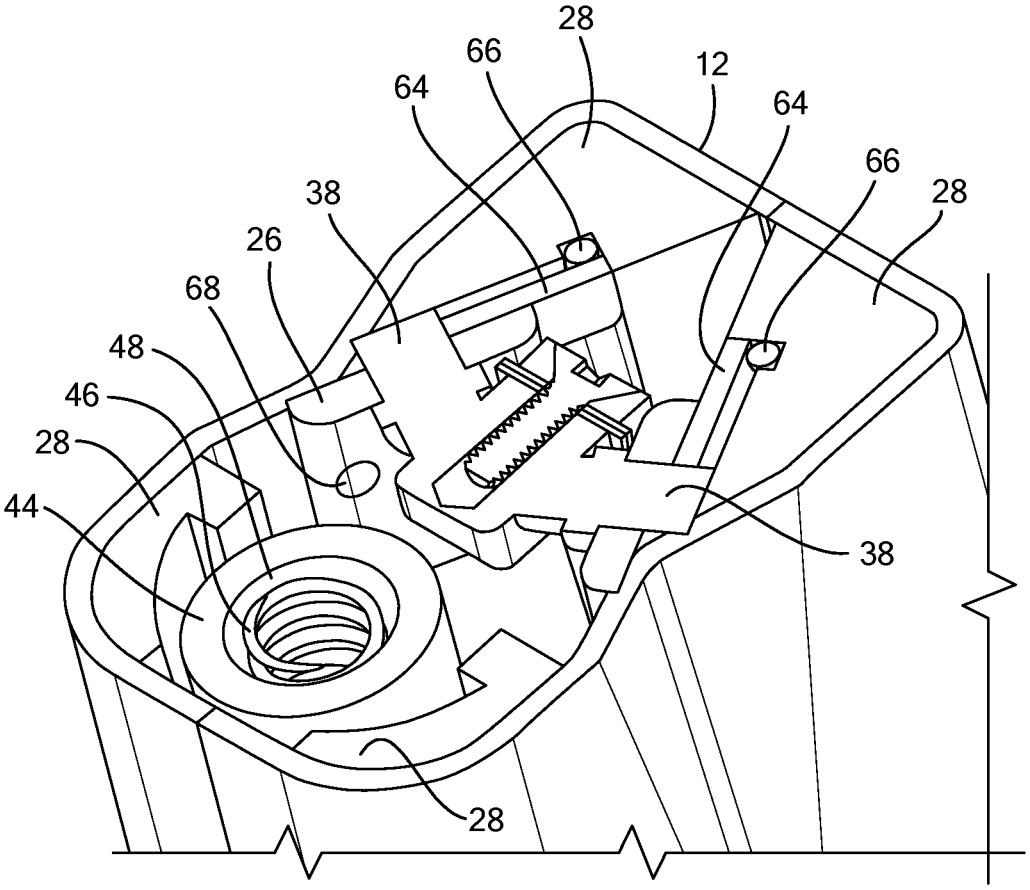
FIG. 7 is a top section view of the housing of FIGS. 2-6, constructed in accordance with the principles of the present invention.

As shown in FIGS. 2-4, the housing 12 further includes a track body 28 that may be integral with or affixed to the inner surface of the housing 12 between the first and second ends 14, 16 of the housing 12. As shown in FIG. 7, the track body 28 defines a plurality of tracks or grooves 30 that allow for movement of a tracking mechanism 32 that is configured to control and facilitate deployment and retraction of the plurality of support members 26. As a non-limiting example, the track body 28 may be made of metal or polymer, and also has a housing locking notch 34 that is configured to engage a corresponding internal mechanism of the firearm to couple the housing 12 to the firearm 11. Further, the track body 28 also has a different set of tracks or grooves 30 to allow the tracking mechanism 32 to move the support members 26 in a cam-like motion to rotate the support members 26 outward during the transition phase between the retracted and deployed states.

Now referring to FIGS. 2-5, the stand assembly 10 also includes a plurality of support member tensioning elements 36, which may be springs coupled to the track body 28. In some embodiments the support member tensioning elements 36 may be wound or coiled constant-force springs or strip-springs configured to provide upward force to the support members 26 to allow for automatic retraction of the support members 26. The support member tensioning elements 36 allow for automatic retraction of the support members 26 by being attached to a joint mechanism 38 via a spring block 40 and a screw. As described herein, it is to be understood that a portion of each support member 26 is coupled or secured to the joint mechanism 38 and/or the tracking mechanism 32 to facilitate deployment and retraction of the support members 26.

The stand assembly 10 further includes an ejection leaf spring 42 that is a strip of metal that is secured to the track body 28 via a binding agent or fastener. The ejection leaf spring 42 is configured to engage the magazine release mechanism (or other similar release mechanism) of a corresponding firearm to eject the stand assembly 10 from the firearm once the locking notch 34 is disengaged from the firearm 11 by the user.

Figure 5:
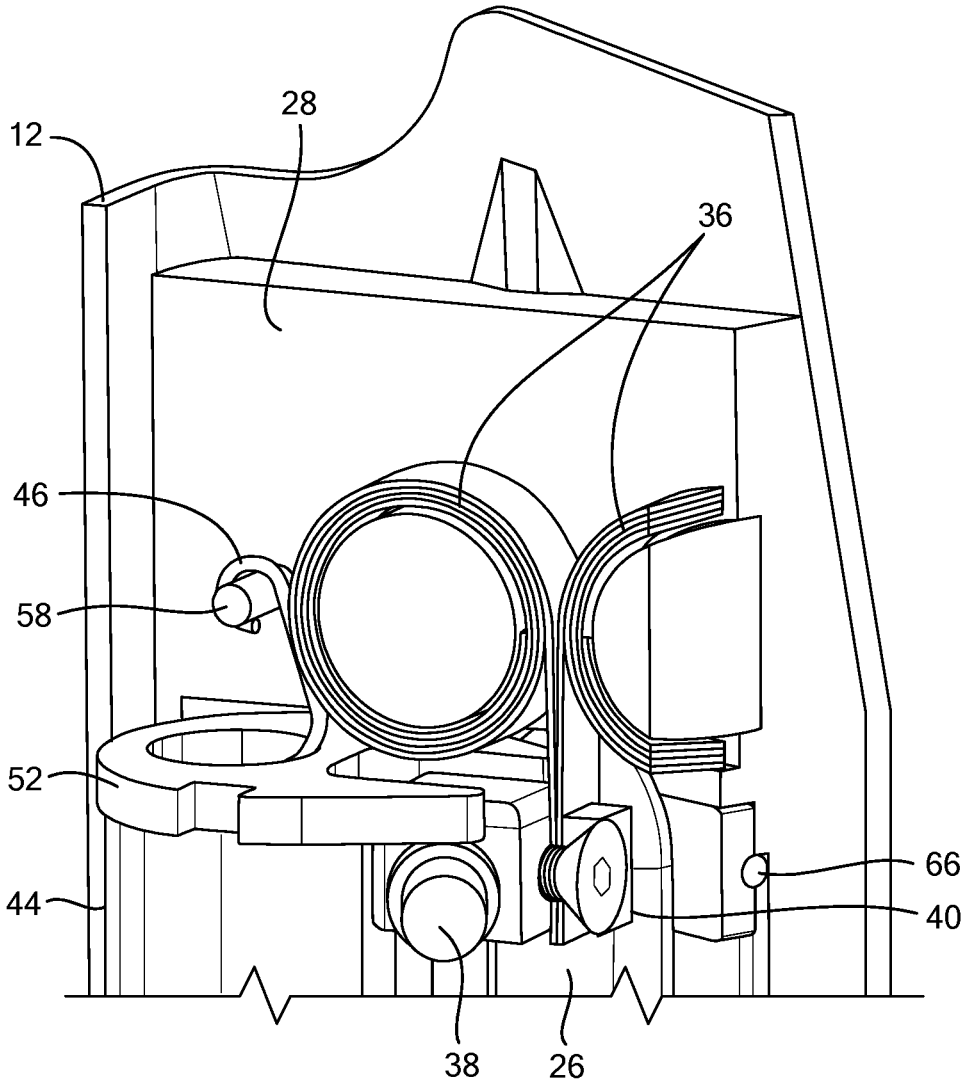
FIG. 5 is a side section view of the upper region of the housing of FIGS. 2-4, constructed in accordance with the principles of the present invention.
Figure 6:
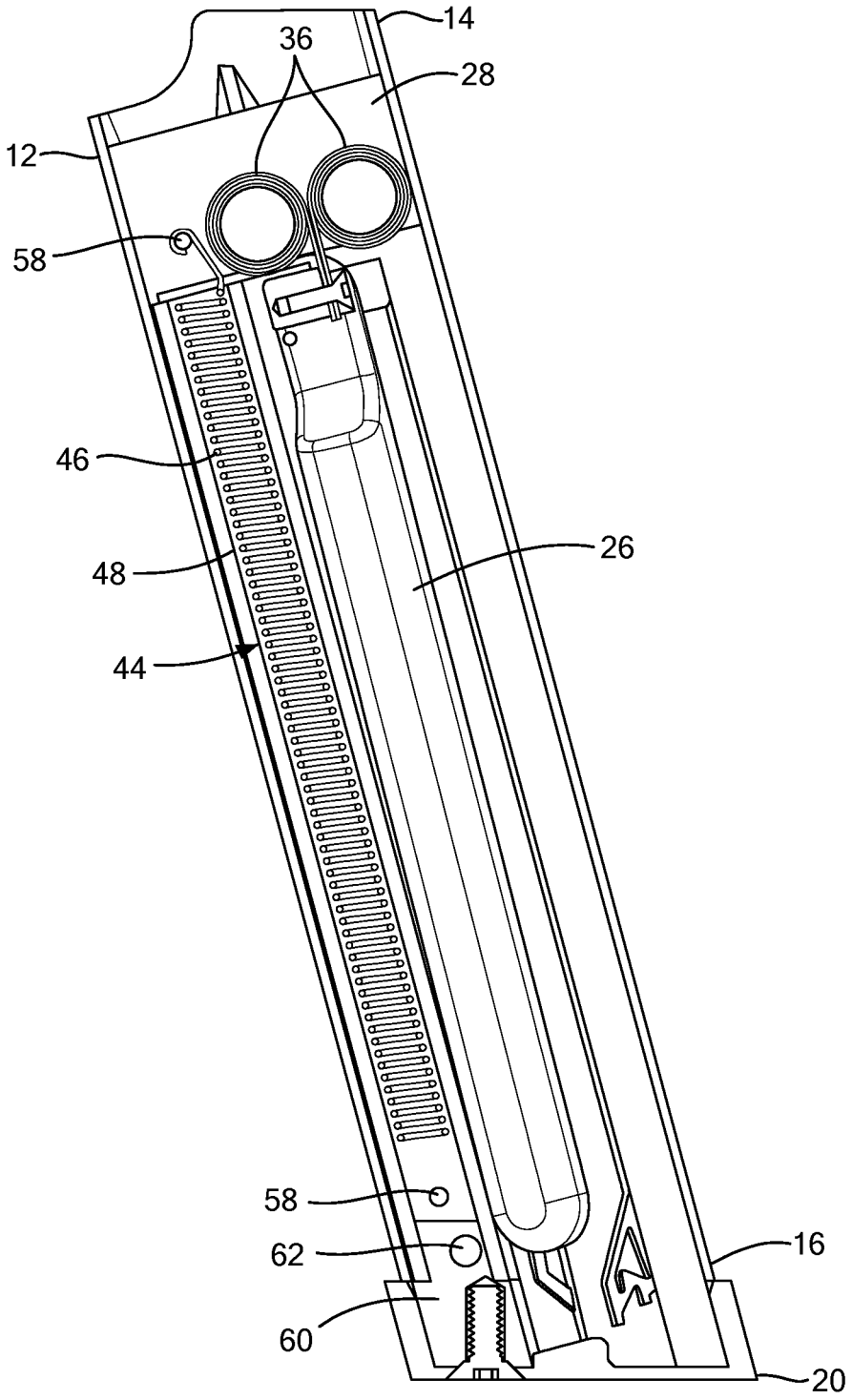
FIG. 6 is a side section view of the housing of FIGS. 2-5 when the stand assembly is in a stowed state, constructed in accordance with the principles of the present invention.

Now referring to FIG. 6, the stand assembly 10 further includes a pull rod 44 and a tensioning element 46 disposed within a channel 48 defined by an inner surface of the pull rod 44. As shown in FIG. 6, the pull rod 44 has an elongate body 50 with a first end 52, a second end 54 opposite the first end 52, and a lateral surface 56 therebetween. When in the stowed state, the pull rod 44 is fully retained within the housing 12 and the elongate body 50 extends between the first and second ends 14, 16 of the housing. As shown in FIG. 5, a portion of the first end 52 of the elongate body 50 is configured to engage and move the joint mechanism 38 downwards during the deployment of the support members 26. Although not shown, the first end 52 of the elongate body 50 has notches configured to engage with the track body 28 to constrain movement of the pull rod 44 to only along the long axis of the housing and prevent rotation of the pull rod 44.

As described herein, it is to be understood that the tensioning element 46 may be a tension spring with loops at the end of its length. The tensioning element 46 is secured at the top of the track body 28 proximate to the first end 14 of the housing 12 with tensioning element pins 58 and secured to the second end 54 of the elongate body 50 via another tensioning element pin 58. The tensioning element 46 is configured to allow for the return of the pull rod 44 and the base 20 to their original positions following movement of the pull rod 44 and base 20 by the user during a transition of the stand assembly 10 between the stowed state and deployed state.

Further the stand assembly 10 includes a pull adapter 60, which is a semi-round object that is secured to the base 20 by a screw. The pull adapter 60 is connected to the pull rod 44 and secured using the pull adapter pin 62, which is a cylindrical fastener used to secure the pull adapter 60 to the pull rod 44.

Now referring to FIG. 7, the tracking mechanism 32 is shown in more detail. The tracking mechanism comprises a track block 64. The track block is coupled to a track ball bearing 66 that allows the track block 64 to slide along the length of a track or groove 30 of the track body 28. Because each support member 26 is secured to the joint mechanism 38, each support member 26 may move along the track or grooves 30 within the track body 28 as the track block 64 moves along the grooves 30 via the track ball bearing 66.

Figure 8:
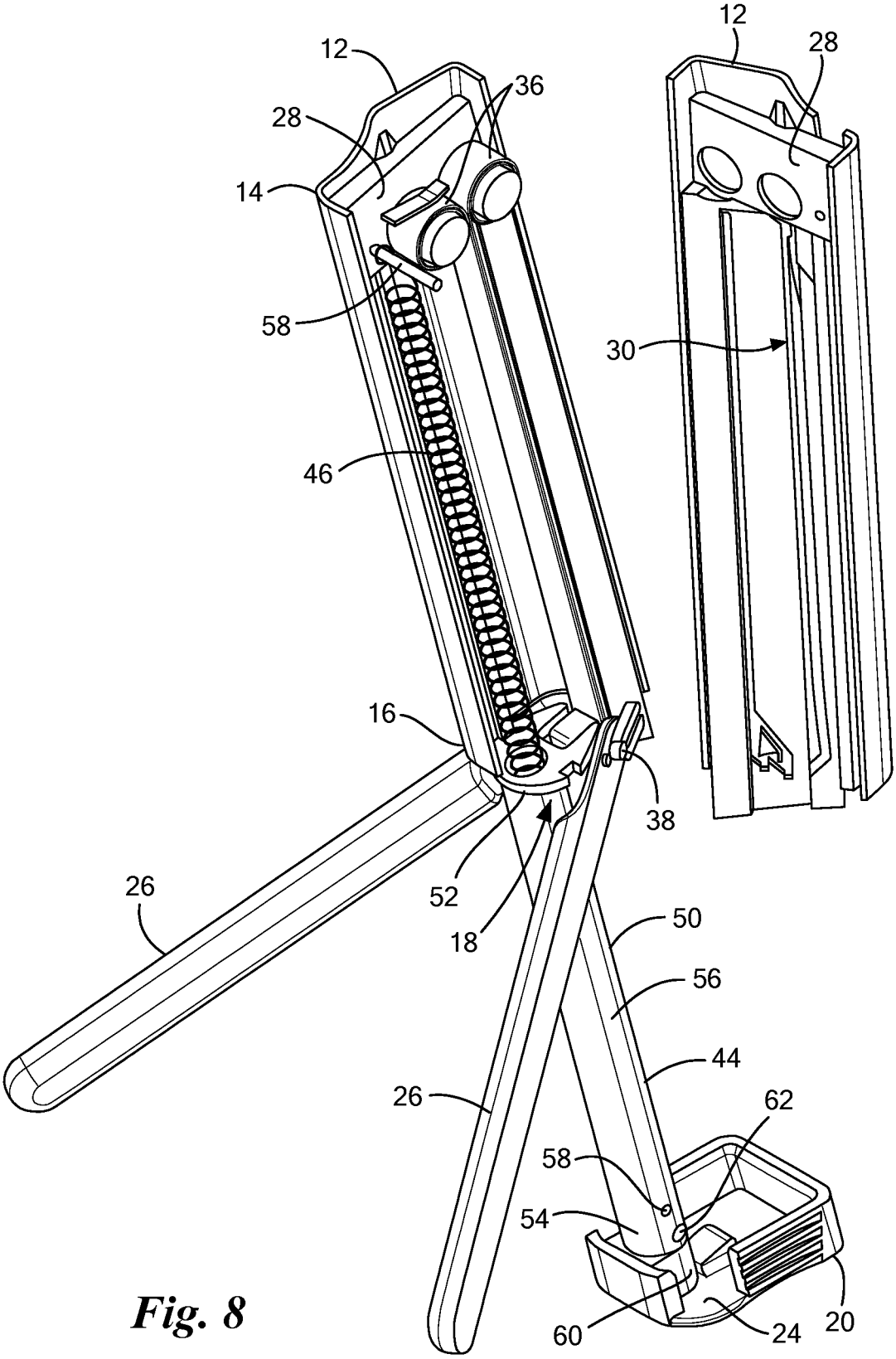
FIG. 8 is an exploded isometric view of the housing of FIGS. 2-7 when the stand assembly is in a transition state between the stowed state and deployed state, in accordance with the principles of the present invention.
Figure 9:
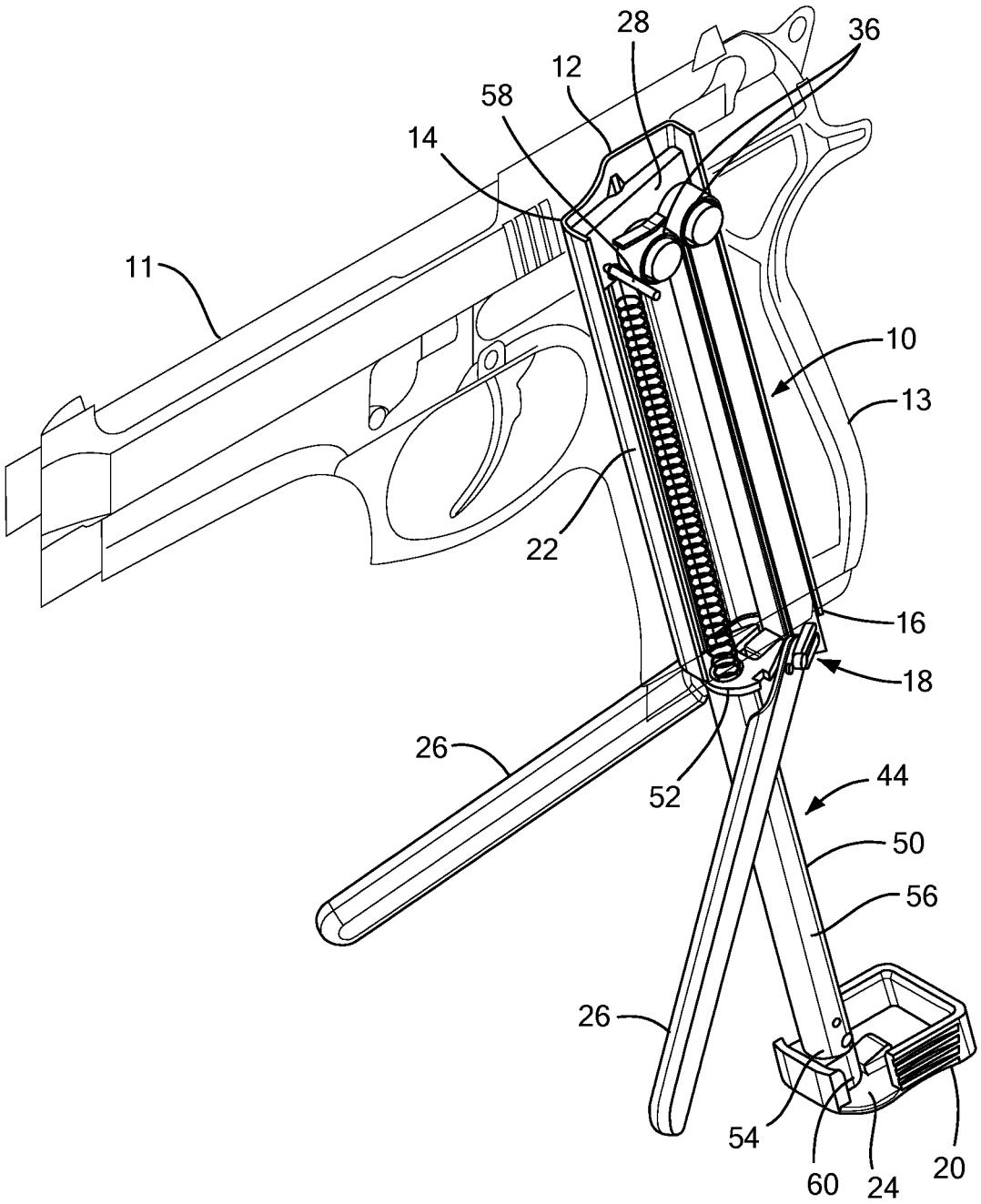
FIG. 9 is a side section view of the stand assembly of FIGS. 1-8 when coupled to the firearm and in the transition state between the stowed state and deployed state, in accordance with the principles of the present invention.

Now referring to FIG. 8, the stand assembly 10 may readily transition between the stowed state and the deployed state upon the user or operator's engagement of the base 20. For example, as shown in FIG. 7, a user may pull the base 20 distally away from the second end 16 of the housing 12. Because the pull rod 44 is secured to the base 20, moving the base 20 distally away from the housing 12 causes the pull rod 44 to move towards the second end of the housing 12 and protrude through the opening 18 such that the first end 52 of the elongate body 50 is proximate or adjacent to the opening 18. Notably, however, the tensioning element 46 remains in a fixed position but stretches or expands as the user pulls the base 20 and pull rod 44 distally away from the housing 12. This causes the tensioning element 46 to become increasingly tensioned, which allows for the return of the pull rod 44 and base 20 to their original stowed state position even when the stand assembly 10 as a whole transitions to the deployed state (for example, as shown in FIG. 1).

Further, as shown in FIG. 8, as the pull rod 44 and base 20 are moved distally away from the housing 12, the plurality of support members 26 move downwards along the track body 28 via the tracking mechanism 32 such that the portion of each support member 26 that is coupled to the joint mechanism 38 is proximate to the second end 16 of the housing 12. Once in this position, track pins 68 enable each support member 26 to move in a cam-like motion along the track body 28 and rotate outwards to protrude (or deploy) through the opening 18 while a portion of each support member 26 is still retained within the housing 12.

Once the plurality of support members 26 are fully deployed from the housing 12, the track pins 68 may engage the track body 28 to lockingly fix the plurality of support members 26 in place so that they remain in the deployed state. The pull rod 44 and base 20 (which had been previously moved distally away from the housing 12) may then be returned to their original position proximate the housing 12 such that the base may re-engage or circumscribe the second end 16 of the housing 12 to seal, or at least partially seal, the opening 18. When in this position, the deployed support members 26 may rest within and protrude through the openings 24 of the base 20 even though the pull rod 44 and base 20 have returned to their original stowed state positions (for example, as shown in FIG. 1).

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

Having thus described the invention of the present application in detail and by reference to embodiments thereof, it will be apparent that modifications and variations are possible without departing from the scope of the invention defined in the appended claims as follows:

What is claimed is:

1. A stand assembly for providing support to a firearm, comprising:

a housing, the housing including:

a track body, the track body defining a plurality grooves;

a tracking mechanism configured to slidably engage the track body and navigate along the plurality of grooves;

a joint mechanism coupled to the tracking mechanism; and a plurality of support members and a pull rod coupled to the joint mechanism; and a base secured to the pull rod, the base being configured to releasably circumscribe an outer surface of the housing; and wherein the plurality of support members are configured to transition from a retracted position within the housing to a deployed position outside of the housing when the base is released from the outer surface of the housing and moved distally away from the housing.

2. The stand of claim 1, wherein the pull rod comprises an elongate body defining a channel therein.

3. The stand of claim 2, wherein a tensioning element is disposed within the channel.

4. The stand of claim 3, wherein the housing has a first end and an opposite second end, the second end defining an opening providing access to an interior of the housing.

5. The stand of claim 4, wherein moving the base distally away from the housing causes the pull rod to partially exit the housing through the opening.

6. The stand of claim 5, wherein the tensioning element becomes increasingly tensioned as the pull rod exits the housing through the opening.

7. The stand of claim 6, wherein the tensioning element is a spring.

8. The stand of claim 6, wherein the base defines a plurality of openings sized and configured to allow for passage of a support member when the plurality of support members are deployed from the housing.

9. The stand of claim 8, wherein upon full deployment of the plurality of support members, each support member may be locked in place to maintain their deployed position.

10. The stand of claim 9, wherein the base is configured to engage the housing and provide at least a partial seal over the opening when the plurality of support members are fully deployed from the housing.

11. A stand assembly for use with a projectile launcher, comprising:

a housing, the housing including:

a first end and a second end opposite the first end, the second end defining an opening that provides access to an interior of the housing;

a tracking mechanism disposed within the interior of the housing;

a joint mechanism coupled to the tracking mechanism; and a plurality of support members and a pull rod each being coupled to the joint mechanism; and wherein the plurality of support members are configured to be readily deployed from and retracted within the interior of the housing through the opening.

12. The stand of claim 11, wherein deployment of the plurality of support members causes each support member to rotate about an axis when exiting the housing through the opening.

13. The stand of claim 11, further including a base, the base being coupled to the pull rod and configured to releasably circumscribe a portion of the housing.

14. The stand of claim, 13, wherein moving the base distally away from the housing causes the pull rod to partially exit the housing through the opening.

15. The stand of claim 13, wherein the base defines a plurality of openings sized and configured to allow for passage of a support member when the plurality of support members are deployed from the housing.

16. The stand of claim 15, wherein upon full deployment of the plurality of support members, each support member may be locked in place to maintain their deployed position.

17. The stand of claim 16, wherein the base is configured to engage the housing and provide at least a partial seal over the opening when the plurality of support members are fully deployed from the housing.

18. The stand of claim 11, wherein the pull rod comprises an elongate body defining a channel therein.

19. The stand of claim 18, wherein a tensioning element is disposed within the channel.

* * * * *